US008659484B2

(12) United States Patent
Cheng

(10) Patent No.: US 8,659,484 B2
(45) Date of Patent: Feb. 25, 2014

(54) PRINTED ANTENNA

(75) Inventor: Shih-Chieh Cheng, Tainan (TW)

(73) Assignee: Arcadyan Technology Corporation, Hsinchu (TW)

( * ) Notice: Subject to any disclaimer, the term of this patent is extended or adjusted under 35 U.S.C. 154(b) by 170 days.

(21) Appl. No.: 13/434,126

(22) Filed: Mar. 29, 2012

(65) Prior Publication Data

US 2013/0009843 A1 Jan. 10, 2013

(30) Foreign Application Priority Data

Jul. 4, 2011 (TW) ..... 100123559 A

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 7,180,463 | B2 * | 2/2007 | Chung | 343/824 |
| 8,462,061 | B2 * | 6/2013 | Brown | 343/725 |
| 2008/0042904 | A1 * | 2/2008 | Shih | 343/700 MS |

* cited by examiner

*Primary Examiner* — Hoang V Nguyen
(74) *Attorney, Agent, or Firm* — Rabin & Berdo, P.C.

(57) ABSTRACT

A printed antenna comprising a substrate, a first ground plane, a low frequency radiation, a high frequency radiation, a first matching portion, a second matching portion is provided. The first ground plane, the low frequency radiation portion, the high frequency radiation portion and the first matching portion are located on an upper surface of the substrate. The low frequency radiation portion is connected to the high frequency radiation portion, and the first matching portion is extended from the first ground plane and towards the high frequency radiation portion. The second matching portion is adjacent to the first matching portion but does not overlap the first matching portion.

13 Claims, 8 Drawing Sheets

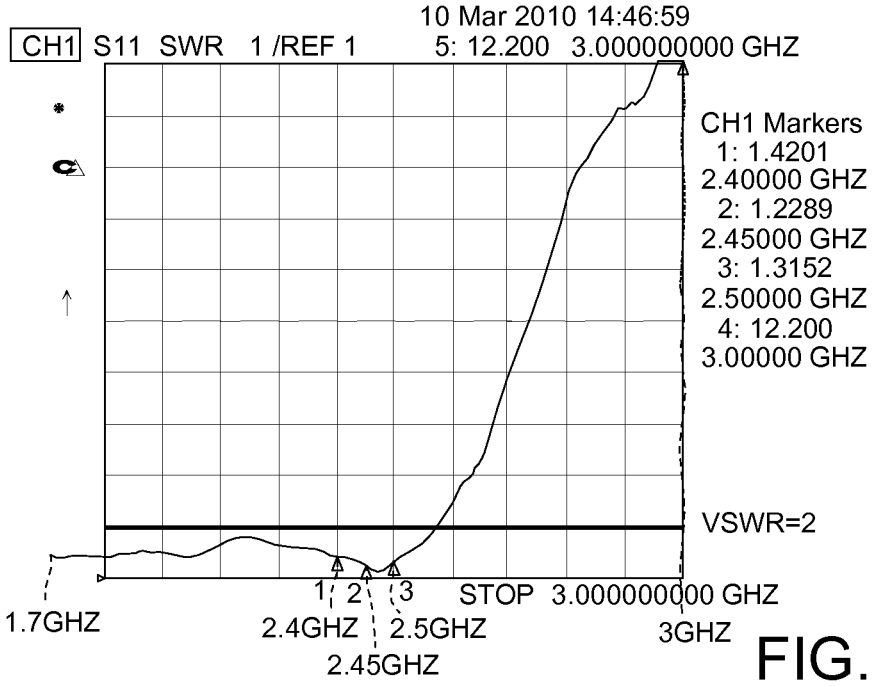
FIG. 3
| frequency (GHZ) | | 2.4 | 2.45 | 2.5 |
|---|---|---|---|---|
| X-Y plane | peak gain (dBi) | 3.49 | 3.85 | 3.43 |
| | average gain (dBi) | -1.13 | -1.32 | -1.73 |
| Y-Z plane | peak gain (dBi) | 3.62 | 3.26 | 2.71 |
| | average gain (dBi) | 0.09 | -0.30 | -0.95 |
| X-Z plane | peak gain (dBi) | 2.29 | 2.13 | 2.16 |
| | average gain (dBi) | 0.96 | 0.51 | 0.46 |
FIG. 4
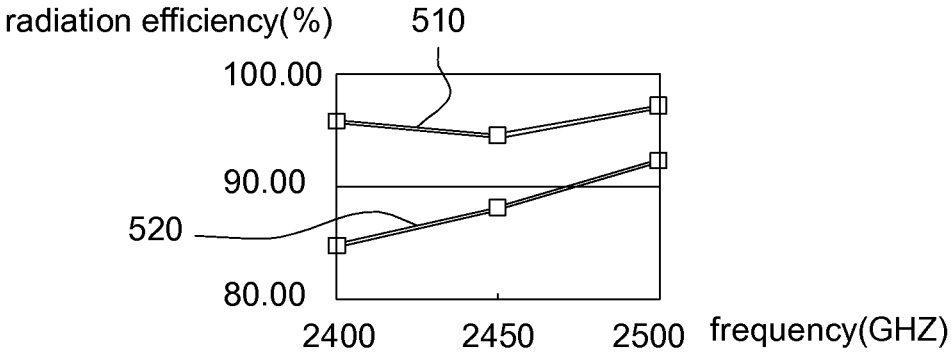
FIG. 5

PRINTED ANTENNA

This application claims the benefit of Taiwan application Serial No. 100123559, filed Jul. 4, 2011, the subject matter of which is incorporated herein by reference.

BACKGROUND OF THE INVENTION

1. Field of the Invention

The invention relates in general to a printed antenna, and more particularly to a printed antenna used in a wireless network device.

2. Description of the Related Art

Along with the advance in computer and wireless telecommunication technology, wireless area network (WLAN) has been widely used in people's everyday life. Currently, many electronic devices may be connected to a WAN via a wireless network device such as a USB dongle, an access point (AP) or a router.

Conventional wireless network device may receive/transmit wireless signals via an external dipole antenna. Since the external dipole antenna not only jeopardizes the appearance aesthetics of the device but also requires additional purchase cost, the printed antenna formed on the printed circuit board gradually replaces the dipole antenna.

However, the radiation gain and the radiation efficiency of the conventional printed antenna are inferior to that of the dipole antenna, and the bandwidth of the conventional printed antenna is limited to a narrowed range.

SUMMARY OF THE INVENTION

The invention is directed to a printed antenna. Through appropriate circuit layout design, the area of the printed antenna on the substrate is reduced, and both the radiation gain and the radiation efficiency are increased. Besides, the bandwidth of the printed antenna is further increased.

According to an aspect of the present invention, a printed antenna comprising a substrate, a first ground plane, a low frequency radiation, a high frequency radiation, a first matching portion, a second matching portion is provided. The substrate comprises an upper surface and a lower surface opposite to the upper surface. The first ground plane, the low frequency radiation portion, the high frequency radiation portion and the first matching portion are located on upper surface. The first ground plane has a first ground lateral side. The low frequency radiation portion comprises a first belt-like radiation portion, a second belt-like radiation portion and a third belt-like radiation portion. One end of the second belt-like radiation portion is connected to one end of the first belt-like radiation portion to form a first bending. One end of the third belt-like radiation portion is connected to the other end of the second belt-like radiation portion to form a second bending. The first belt-like radiation portion, the second belt-like radiation portion and the third belt-like radiation portion together form an opening.

The high frequency radiation portion, disposed inside the opening, comprises a first high frequency lateral side and a second high frequency lateral side. The first high frequency lateral side is opposite to the first bending, and one end of the first high frequency lateral side is connected to the other end of the third belt-like radiation portion. The second high frequency lateral side is parallel to the first belt-like radiation portion, and one end of the second high frequency lateral side is connected to the other end of the first high frequency lateral side to form an acute angle. The first matching portion is located on a vertical connection line connecting the vertex of an acute angle and the first ground lateral side. The first matching portion is extended from the first ground lateral side and towards the first belt-like radiation portion. The second matching portion is adjacent to the first matching portion but does not overlap the first matching portion.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

FIG. 3 shows a SWR wave-pattern diagram of a printed antenna according to a first embodiment of the invention;

FIG. 4 shows a comparison of the radiation gain of a printed antenna under different measurement planes according to a first embodiment of the invention;

FIG. 5 shows a radiation efficiency measurement chart of a printed antenna and a conventional dipole antenna according to a first embodiment of the invention;

DETAILED DESCRIPTION OF THE INVENTION

To further increase the radiation gain and the radiation efficiency, various printed antennas are provided in the embodiments below. A printed antenna comprises a substrate, a first ground plane, a low frequency radiation, a high frequency radiation, a first matching portion, a second matching portion. The substrate comprises upper surface and a lower surface opposite to the upper surface. The first ground plane, the low frequency radiation portion, the high frequency radiation portion and the first matching portion are located on upper surface. The first ground plane has a first ground lateral side. The low frequency radiation portion comprises a first belt-like radiation portion, a second belt-like radiation portion and a third belt-like radiation portion. One end of the second belt-like radiation portion is connected to one end of the first belt-like radiation portion to form a first bending. One end of the third belt-like radiation portion is connected to the other end of the second belt-like radiation portion to form a second bending. The first belt-like radiation portion, the second belt-like radiation portion and the third belt-like radiation portion together form an opening.

The high frequency radiation portion, disposed inside the opening, comprises a first high frequency lateral side and a second high frequency lateral side. The first high frequency lateral side is opposite to the first bending, and one end of the first high frequency lateral side is connected to the other end of the third belt-like radiation portion. The second high frequency lateral side is parallel to the first belt-like radiation portion, and one end of the second high frequency lateral side is connected to the other end of the first high frequency lateral side to form an acute angle. The first matching portion is located on a vertical connection line connecting the vertex of an acute angle and the first ground lateral side. The first matching portion is extended from the first ground lateral side and towards the first belt-like radiation portion. The second matching portion is adjacent to the first matching portion but does not overlap the first matching portion.

First Embodiment

Figure 1:
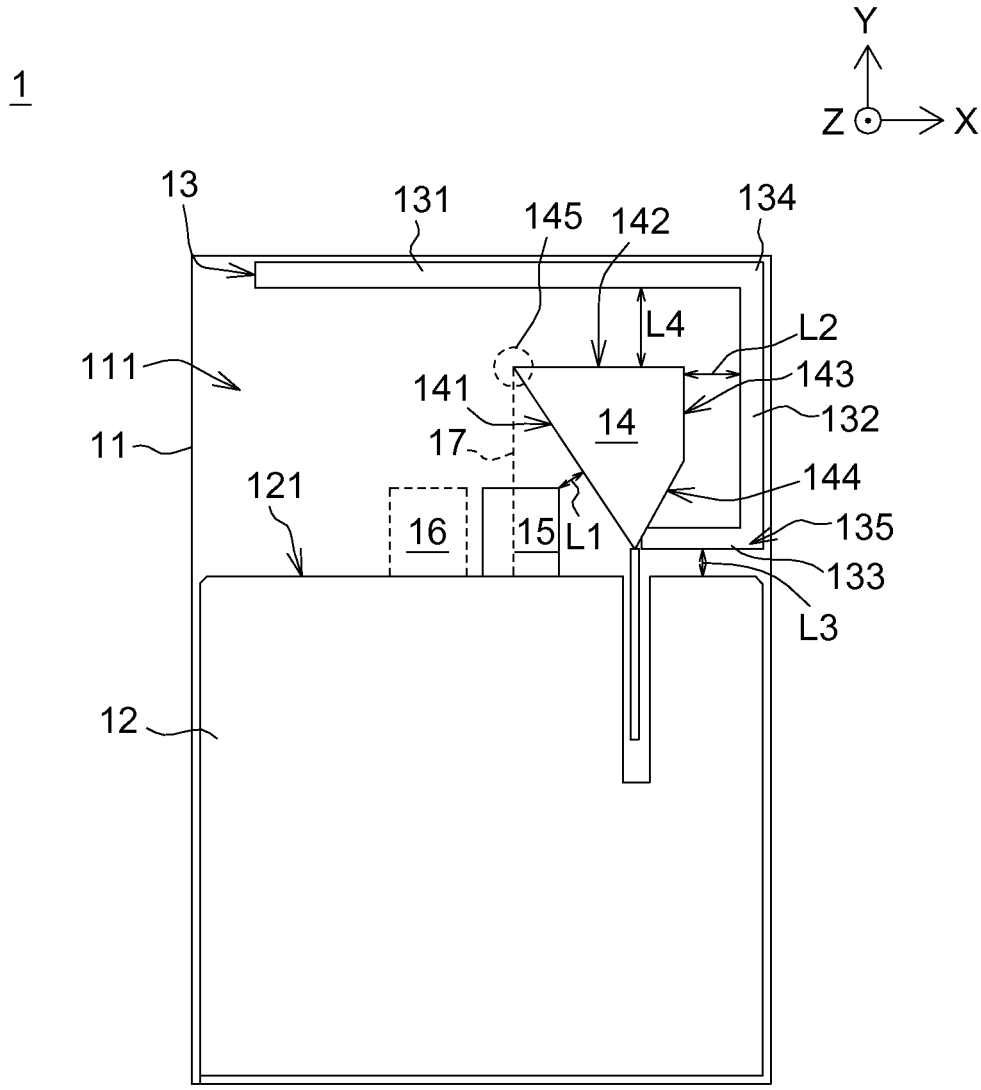
FIG. 1 shows a partial top view of a printed antenna according to a first embodiment of the invention.
Figure 2:
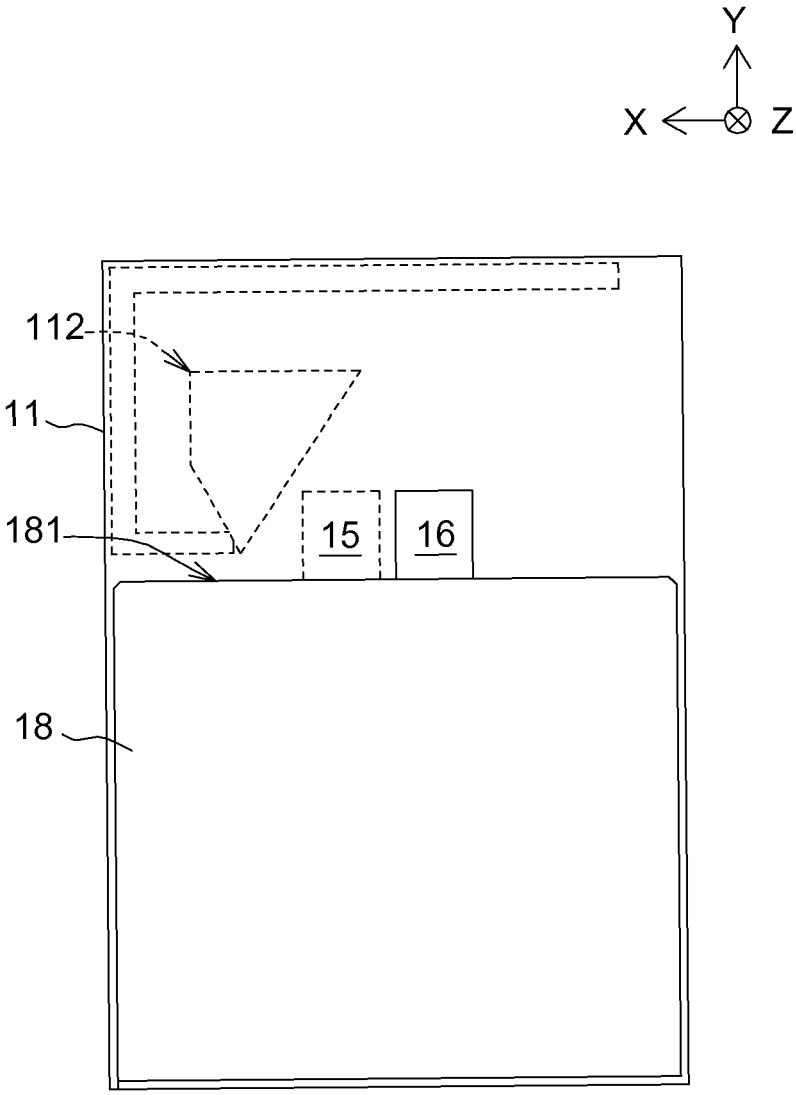
FIG. 2 shows a partial bottom view of a printed antenna according to a first embodiment of the invention.

Referring to FIG. 1 and FIG. 2. FIG. 1 shows a partial top view of a printed antenna according to a first embodiment of the invention. FIG. 2 shows a partial bottom view of a printed antenna according to a first embodiment of the invention. The printed antenna 1 is, for example, used in a wireless network device, such as a USB dongle, an access point (AP) or a router. The printed antenna 1 illustrated in FIG. 1 is placed on an x-y plane, and the z direction denotes the direction perpendicular to the x-y plane. The printed antenna 1 comprises a substrate 11, a first ground plane 12, a low frequency radiation portion 13, a high frequency radiation portion 14, a first matching portion 15, a second matching portion 16 and a second ground plane 18. The printed antenna 1 may be distributed within an 18 mm×11 mm rectangular region so that the area occupied by the printed antenna 1 is effectively reduced. The substrate 11 comprises an upper surface 111 and a lower surface 112 opposite to the upper surface 111. The first ground plane 12, the low frequency radiation portion 13, the high frequency radiation portion 14 and the first matching portion 15 are located on the upper surface 111. The second matching portion 16 and the second ground plane 18 are located on the lower surface 112. The first ground plane 12 and the second ground plane 18 have a first ground lateral side 121 and a second ground lateral side 181 respectively adjacent to the low frequency radiation portion 13 and the high frequency radiation portion 14. The low frequency radiation portion 13 and the high frequency radiation portion 14 are operated at 2.4 GHz and 5 GHz respectively.

The low frequency radiation portion 13 comprises a first belt-like radiation portion 131, a second belt-like radiation portion 132 and a third belt-like radiation portion 133. One end of the second belt-like radiation portion 132 is connected to one end of the first belt-like radiation portion 131 to form a first bending 134. One end of the third belt-like radiation portion 133 is connected to the other end of the second belt-like radiation portion 132 to form a second bending 135. The first belt-like radiation portion 131, the second belt-like radiation portion 132 and the third belt-like radiation portion 133 form an opening for accommodating the high frequency radiation portion 14.

The high frequency radiation portion 14 is disposed inside the opening formed by the first belt-like radiation portion 131, the second belt-like radiation portion 132 and the third belt-like radiation portion 133. The high frequency radiation portion 14 comprises a first high frequency lateral side 141, a second high frequency lateral side 142, a third high frequency lateral side 143 and a fourth high frequency lateral side 144. The second high frequency lateral side 142 connects the first high frequency lateral side 141 and the third high frequency lateral side 143, and the fourth high frequency lateral side 144 connects the first high frequency lateral side 141 and the third high frequency lateral side 143 to form quadrilateral. The first high frequency lateral side 141 and the fourth high frequency lateral side 144 are respectively opposite to the first bending 134 and the second bending 135. One end of the first high frequency lateral side 141 is connected to the other end of the third belt-like radiation portion 133. The second high frequency lateral side 142 is parallel to the first belt-like radiation portion 131, and the third high frequency lateral side 143 is perpendicularly connected to the second high frequency lateral side 142. One end of the second high frequency lateral side 142 is connected to the other end of the first high frequency lateral side 141 to form an acute angle 145.

The first matching portion 15 is located on a vertical connection line 17 connecting the vertex of an acute angle 145 and the first ground lateral side 121. The first ground lateral side 121 is extended towards the first belt-like radiation portion 131. The second matching portion 16 is extended from the second ground lateral side 181 and towards the first belt-like radiation portion 131. The second matching portion 16 is adjacent to the first matching portion but does not overlap the first matching portion 15. The second matching portion 16 and the first matching portion 15 are symmetric to each other in a left-right manner but do not overlap with each other. Besides, the size and shape of the second matching portion 16 are identical to that of the first matching portion 15.

Furthermore, the distance L1 between the first matching portion 15 and the first high frequency lateral side 141 is 1 mm, and the distance L2 between the third high frequency lateral side 143 and the second belt-like radiation portion 132 ranges between 1.5~2 mm. The distance L3 between the third belt-like radiation portion 133 and the first ground lateral side 121 is 1 mm, and the distance L4 between the first high frequency lateral side 141 and the first belt-like radiation portion 131 ranges between 3.5~4 mm.

Referring to FIG. 3, FIG. 4 and FIG. 5. FIG. 3 shows a SWR wave-pattern diagram of a printed antenna according to a first embodiment of the invention. FIG. 4 shows a comparison of the radiation gain of a printed antenna under different measurement planes according to a first embodiment of the invention. FIG. 5 shows a radiation efficiency measurement chart of a printed antenna and a conventional dipole antenna according to a first embodiment of the invention. When the conventional printed antenna is operated at a low frequency, the bandwidth is limited to a narrow range. Conversely, FIG. 3 shows that when the printed antenna 1 is operated at a low frequency, a larger bandwidth range such as 1.7 GHz~2.5 GHz is obtained. Moreover, the bandwidth of the printed antenna 1 may further be adjusted through the distance L1 between the first matching portion 15 and the first high frequency lateral side 141.

FIG. 4 further shows that the printed antenna 1 has better radiation gain. For example, when the printed antenna 1 operated at 2.4 GHz, 2.45 GHz and 2.5 GHz, the peak gains on the x-y plane are 3.49 dBi, 3.85 dBi and 3.43 dBi respectively. The results show that the radiation gains of the printed antenna 1 are greatly increased. Moreover, FIG. 5 shows that the radiation efficiencies of the printed antenna 1 are superior to that of the conventional dipole antenna. A curve 510 illustrates the radiation efficiencies of the printed antenna 1 operated at different frequencies. A curve 520 illustrates the radiation efficiencies of the conventional dipole antenna operated at different frequencies. When the printed antenna 1 is operated at 2.4 GHz, 2.45 GHz and 2.5 GHz, the radiation efficiency may achieve 95.83%, 94.52% and 97.2% respectively. The radiation efficiencies of the conventional dipole antenna operated at 2.4 GHz, 2.45 GHz and 2.5 GHz may only achieve 84.74%, 88.06% and 92.30% respectively. The radiation efficiencies of the printed antenna 1 operated at 2.4 GHz, 2.45 GHz or 2.5 GHz are all superior to that of the conventional dipole antenna.

Second Embodiment

Figure 6:
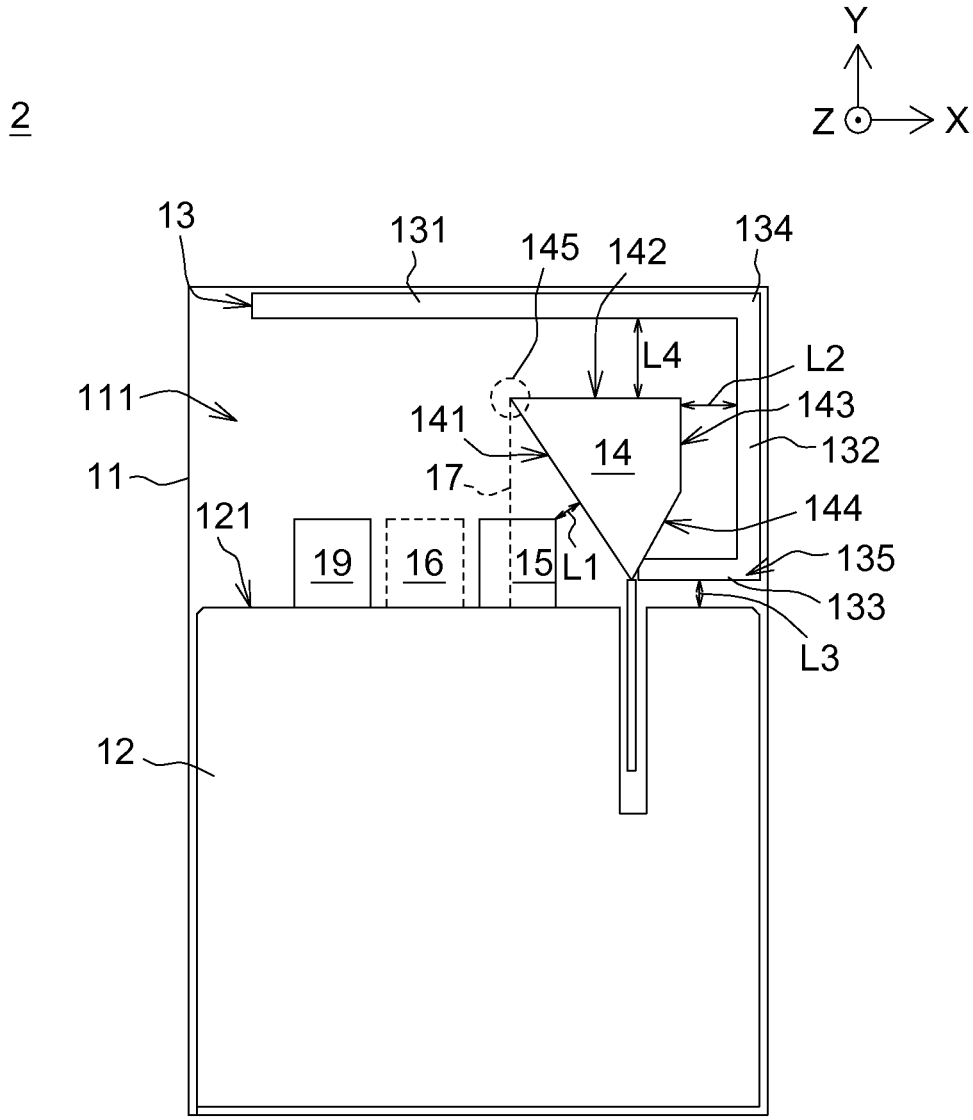
FIG. 6 shows a partial top view of a printed antenna according to a second embodiment of the invention.

Referring to FIG. 6, a partial top view of a printed antenna according to a second embodiment of the invention is shown. The second embodiment is different from the first embodiment in that: the printed antenna 2 further comprises a third matching portion 19 located on the upper surface 12 and the second matching portion 16 is disposed between the first matching portion 15 and the third matching portion 19.

Third Embodiment

Figure 7:
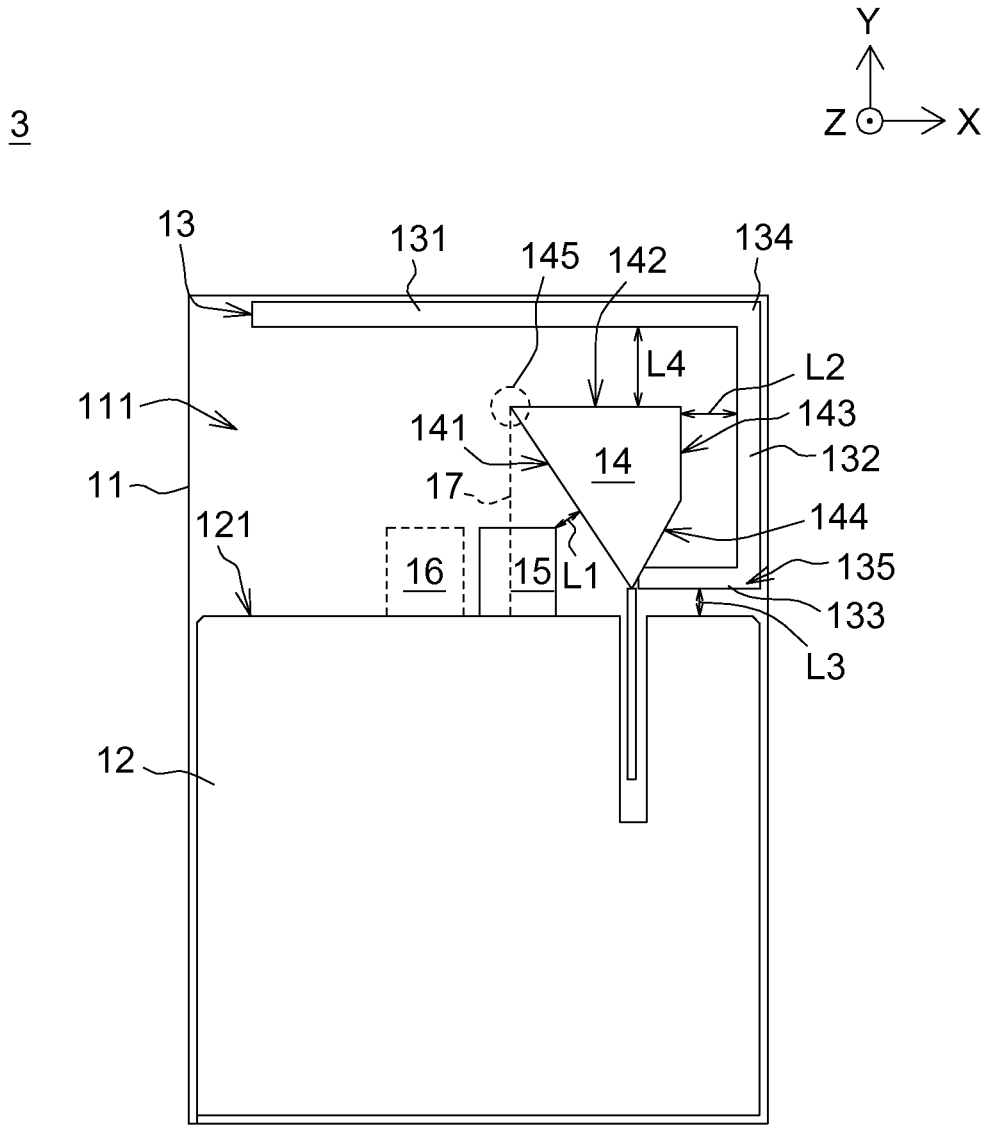
FIG. 7 shows a partial top view of a printed antenna according to a third embodiment of the invention.

Referring to FIG. 7, a partial top view of a printed antenna according to a third embodiment of the invention is shown. The third embodiment is different from the first embodiment in that: the second matching portion 16 of the printed antenna 3 is formed on the upper surface 12, and the second matching portion 16 is extended from the first ground lateral side 121 and towards the first belt-like radiation portion 131.

Fourth Embodiment

Figure 8:
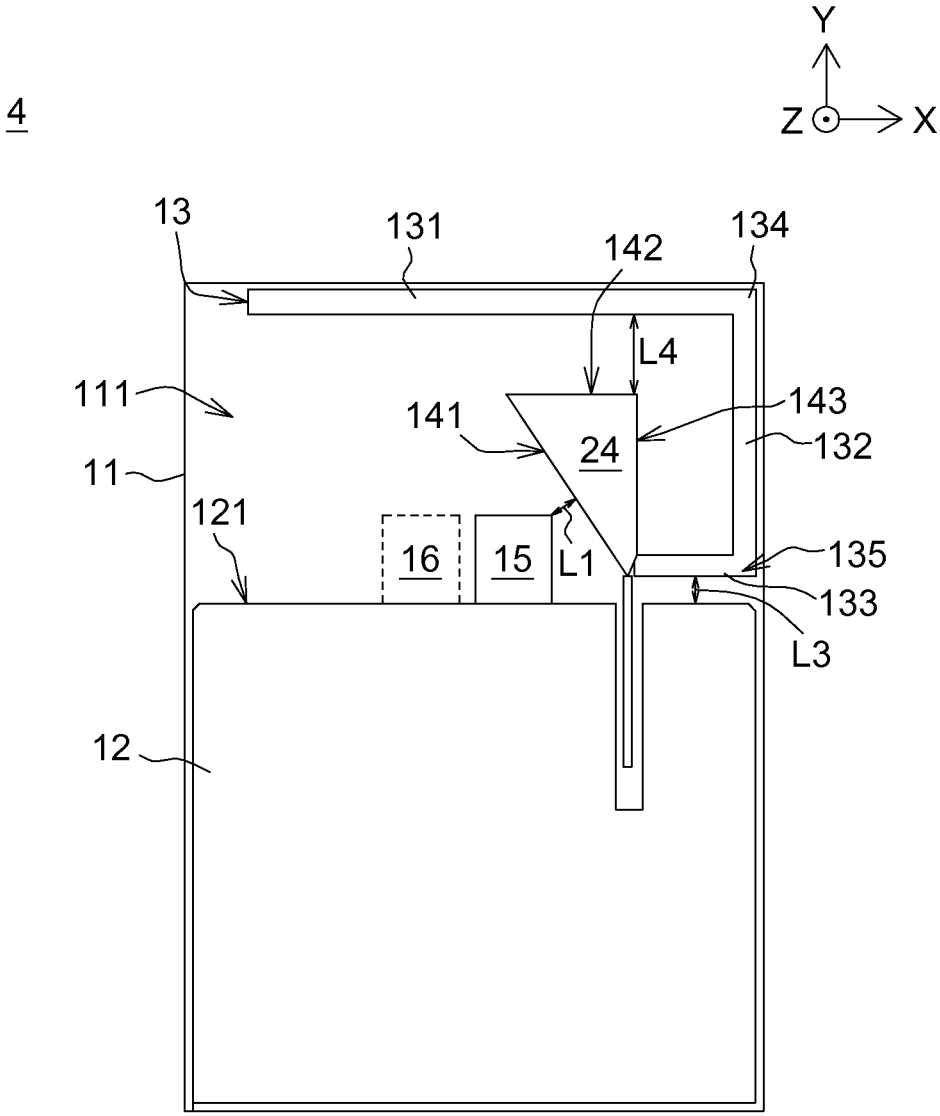
FIG. 8 shows a partial top view of a printed antenna according to a fourth embodiment of the invention.

Referring to FIG. 8, a partial top view of a printed antenna according to a fourth embodiment of the invention is shown. The fourth embodiment is different from the first embodiment in that: the high frequency radiation portion 24 of the printed antenna 4 only comprises a first high frequency lateral side 141, a second high frequency lateral side 142 and a third high frequency lateral side 143. The third high frequency lateral side 143 connects the first high frequency lateral side 141 and the second high frequency lateral side 142 to form a right triangle.

Fifth Embodiment

Figure 9:
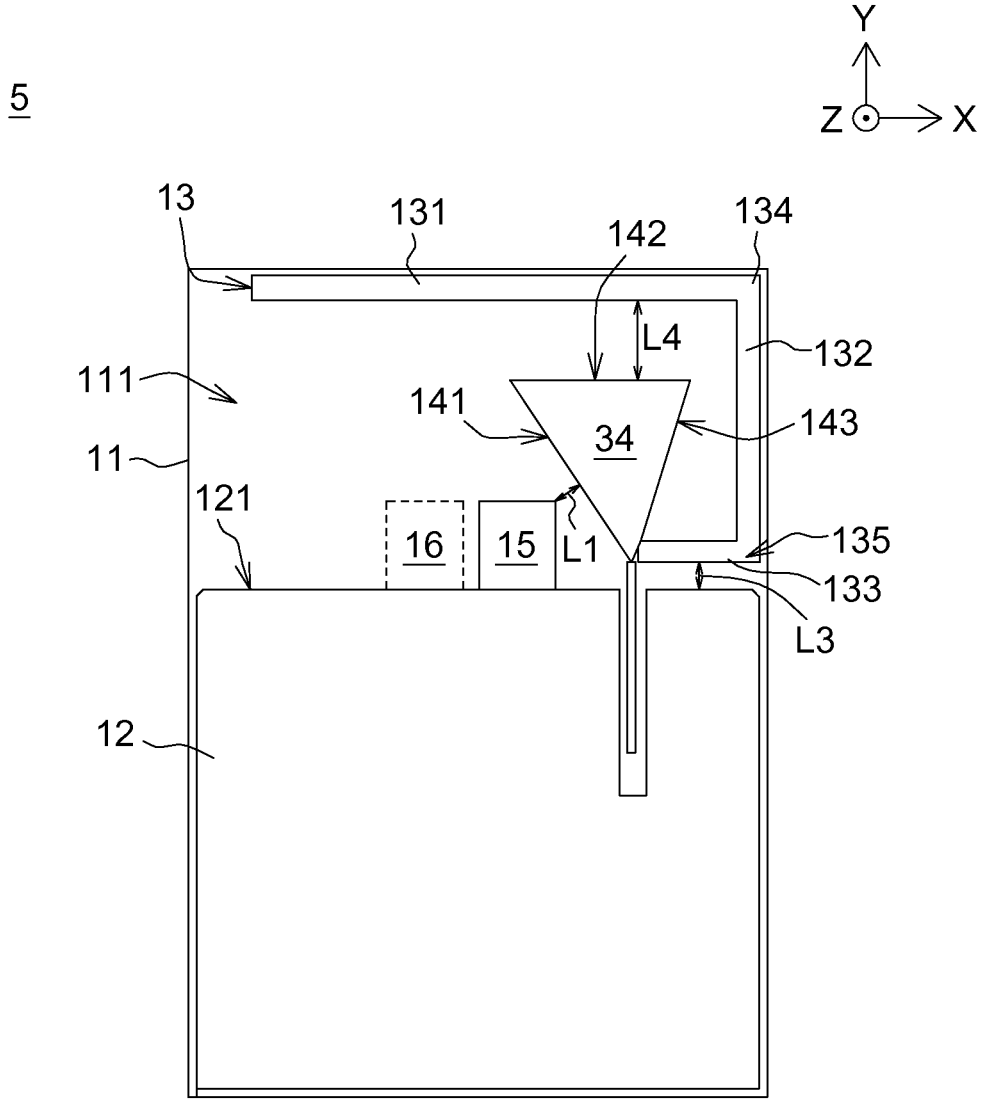
FIG. 9 shows a partial top view of a printed antenna according to a fifth embodiment of the invention.

Referring to FIG. 9, a partial top view of a printed antenna according to a fifth embodiment of the invention is shown. The fifth embodiment is different from the first embodiment in that: the high frequency radiation portion 34 of the printed antenna 5 only comprises a first high frequency lateral side 141, a second high frequency lateral side 142 and a third high frequency lateral side 143. The third high frequency lateral side 143 connects the first high frequency lateral side 141 and the second high frequency lateral side 142 to form a triangle. The third high frequency lateral side 143 is not parallel to the second belt-like radiation portion 132.

Sixth Embodiment

Figure 10:
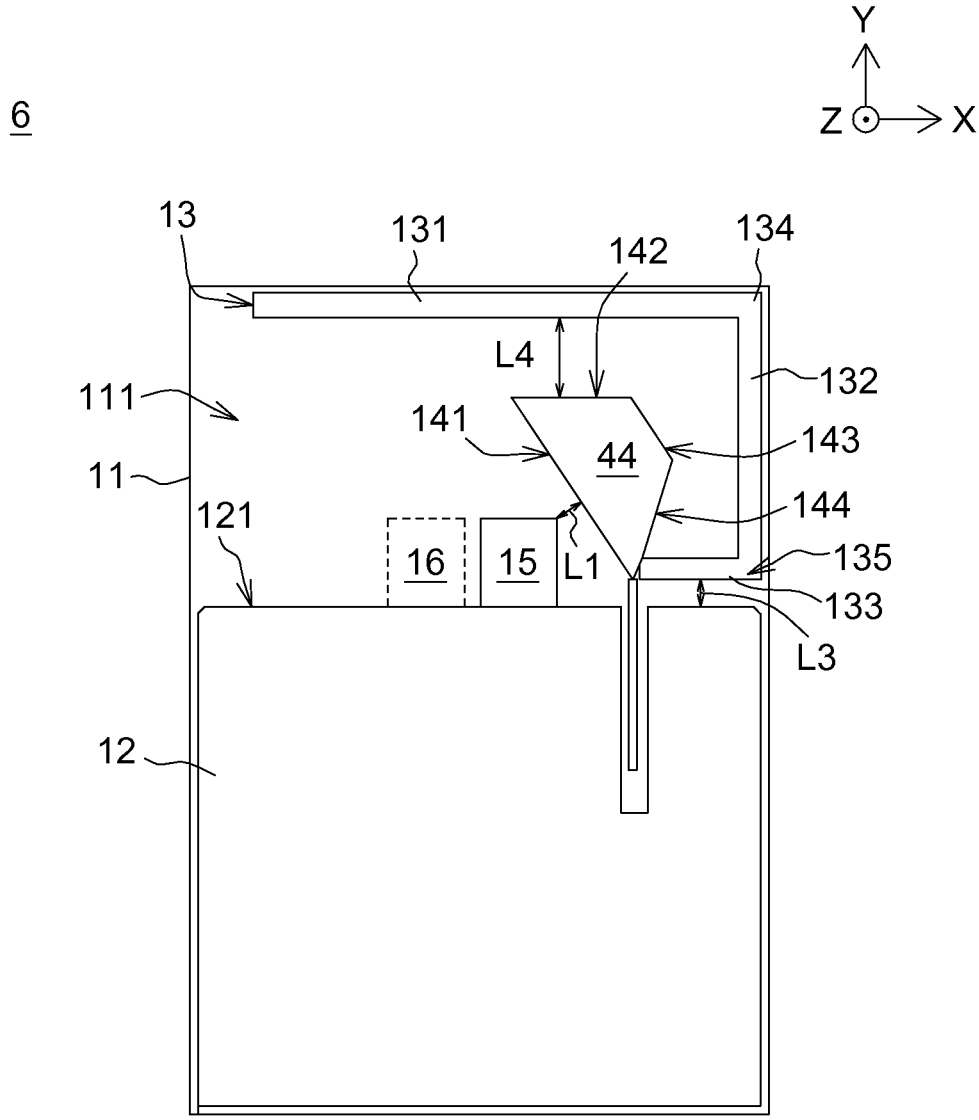
FIG. 10 shows a partial top view of a printed antenna according to a sixth embodiment of the invention.

Referring to FIG. 10, a partial top view of a printed antenna according to a sixth embodiment of the invention is shown. The sixth embodiment is different from the first embodiment in that: the third high frequency lateral side 143 of the high frequency radiation portion 44 of the printed antenna 6 is not parallel to the second belt-like radiation portion 132, but is opposite to the first bending 134.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A printed antenna, comprising:

a substrate, comprising:

an upper surface; and a lower surface opposite to the upper surface;

a first ground plane located on the upper surface and having a first ground lateral side;

a low frequency radiation portion located on the upper surface, wherein the low frequency radiation portion comprises:

a first belt-like radiation portion;

a second belt-like radiation portion, wherein one end of the second belt-like radiation portion is connected to one end of the first belt-like radiation portion to form a first bending; and a third belt-like radiation portion, wherein one end of the third belt-like radiation portion is connected to the other end of the second belt-like radiation portion to form a second bending, and the first belt-like radiation portion, the second belt-like radiation portion and the third belt-like radiation portion together form an opening;

a high frequency radiation portion located on the upper surface and disposed inside the opening, wherein the high frequency radiation portion comprises:

a first high frequency lateral side opposite to the first bending, wherein one end of the first high frequency lateral side is connected to the other end of the third belt-like radiation portion; and a second high frequency lateral side parallel to the first belt-like radiation portion, wherein one end of the second high frequency lateral side is connected to the other end of the first high frequency lateral side to form an acute angle; and a first matching portion located on the upper surface and on a vertical connection line connecting the vertex of an acute angle and the first ground lateral side, wherein the first matching portion is extended from the first ground lateral side and towards the first belt-like radiation portion; and a second matching portion adjacent to the first matching portion but not overlapping the first matching portion.

2. The printed antenna according to claim 1, further comprising a second ground plane, wherein the second ground plane comprises a second ground lateral side, the second ground plane and the second matching portion are formed on the lower surface, and the second matching portion is extended from the second ground lateral side and towards the first belt-like radiation portion.

3. The printed antenna according to claim 2, further comprising a third matching portion located on the upper surface, and the second matching portion is disposed between the first matching portion and the third matching portion.

4. The printed antenna according to claim 1, wherein the second matching portion is formed on the upper surface, and the second matching portion is extended from the first ground lateral side and towards the first belt-like radiation portion.

5. The printed antenna according to claim 1, wherein the size and shape of the second matching portion are identical to that of the first matching portion.

6. The printed antenna according to claim 1, wherein the distance between the first matching portion and the first high frequency lateral side is 1 mm.

7. The printed antenna according to claim 1, wherein the high frequency radiation portion further comprises a third high frequency lateral side perpendicularly connected to the second high frequency lateral side, and the distance between the third high frequency lateral side and the second belt-like radiation portion ranges between 1.5~2 mm.

8. The printed antenna according to claim 7, wherein the high frequency radiation portion further comprises a fourth high frequency lateral side connecting the first high frequency lateral side and the third high frequency lateral side.

9. The printed antenna according to claim 1, wherein the high frequency radiation portion further comprises a third high frequency lateral side connecting the first high frequency lateral side and the second high frequency lateral side.

10. The printed antenna according to claim 1, wherein the high frequency radiation portion further comprises a third high frequency lateral side and a fourth high frequency lateral side, the third high frequency lateral side connects the second high frequency lateral side and the fourth high frequency lateral side, and the third high frequency lateral side and the fourth high frequency lateral side are opposite to the first bending and the second bending respectively.

11. The printed antenna according to claim 1, wherein the distance between the third belt-like radiation portion and the first ground lateral side is 1 mm.

12. The printed antenna according to claim 1, wherein the distance between the first high frequency lateral side and the first belt-like radiation portion ranges between 3.5~4 mm.

13. The printed antenna according to claim 1, wherein the second matching portion and the first matching portion are symmetric to each other in a left-right manner.

* * * * *